US006739693B1

(12) United States Patent
Ferringer

(10) Patent No.: US 6,739,693 B1
(45) Date of Patent: May 25, 2004

(54) SYSTEMS AND METHODS FOR OPERATING FLUID EJECTION SYSTEMS USING A PRINT HEAD PREPARATORY FIRING SEQUENCE

(75) Inventor: Michael C. Ferringer, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/248,388

(22) Filed: Jan. 15, 2003

(51) Int. Cl.[7] ..... B41J 2/165
(52) U.S. Cl. ..... 347/22; 347/9; 347/35
(58) Field of Search ..... 347/22, 35, 9–14, 347/19, 23, 29, 30, 32, 92

(56) References Cited

U.S. PATENT DOCUMENTS 4,639,748 A 1/1987 Drake et al.

6,557,971 B1 * 5/2003 Vega et al. ..... 347/35

* cited by examiner

*Primary Examiner*—Shih-Wen Hsieh
(74) *Attorney, Agent, or Firm*—Oliff & Berridge, PLC

(57) ABSTRACT

Current fluid ejector maintenance techniques do not adequately deal with moveable debris particles present in the fluid supply manifold. Such moveable particles within the fluid supply manifold of a fluid ejector head can cause random ejection defects by clogging, restricting and/or blocking the channel inlets and/or filters present in the channel inlets, causing missed or misfired and/of misdirected drops. At least some of a plurality of fluid ejectors can be fired in a sequential pattern. Sequentially firing the fluid ejectors can move movable particles in the direction of the firing sequence. The moved movable particles can be deposited into non-operative areas within the fluid supply manifold, such as, for example, non-firing fluid ejection locations. The fluid ejectors can be fired in a sequential pattern within blocks of the fluid ejectors. For example, a fluid ejector head with 120 fluid ejectors can fire 1 out of every 20 fluid ejectors.

24 Claims, 12 Drawing Sheets

SYSTEMS AND METHODS FOR OPERATING FLUID EJECTION SYSTEMS USING A PRINT HEAD PREPARATORY FIRING SEQUENCE

BACKGROUND OF THE INVENTION

1. Field of Invention

This invention is directed to systems and methods for maintaining and/or enhancing operation of fluid ejection systems.

2. Description of Related Art

Fluid ejection systems, such as drop on demand liquid ink printers, use various methods to eject fluids, including but no limited to piezoelectric, acoustic, phase change, wax based and thermal systems. These systems include at least one fluid ejector from which droplets of fluid are ejected towards a receiving medium, such as a sheet of paper. A channel is defined within each fluid ejector. The fluid is disposed in the channel. Droplets of fluid can be expelled as required from orifices or nozzles at the end of the channels using power pulses.

In some fluid ejection systems, such as, for example, drop on demand thermal ink jet printers, a pressurized reservoir of ink is connected to a plurality of ink channels and, subsequently, the nozzles, via a fluid supply manifold. The fluid supply manifold contains internal, closed walls defining a chamber with an ink fill hole. The fluid supply manifold receives ink from the ink reservoir and distributes it via internal passageways to the plurality of ejector channels. A plurality of sets of channels and associated fluid supply manifolds can be defined within a single fluid ejection system or printhead. One or more filters can be situated within the fluid supply manifold and/or entrance to each channel. The filters are designed to collect solidified waste fluid and other contaminants, bubbles, debris, residue and/or deposits or the like that can negatively impact the fluid ejector.

U.S. Pat. No. 4,639,748 to Drake et al. discloses an internal, integrated filtering system and fabrication process for an ink jet fluid supply manifold. Small passageways are defined within the fluid supply manifold to deliver ink to a plurality of ink channels. Each of the passageways has smaller cross-sectional flow areas than the ink channels. Therefore, any contaminating particle in the ink that would have passed to the ink channels will be filtered or stopped by the passageways before entering the ink channels.

In drop-on-demand thermal ink jet printers, a heating element normally located in the ink channel causes the ink to form bubbles. By applying a voltage across the heating element, such as a heater transducer or resistor, a vapor bubble is formed. The bubbles force the droplets of ink from the nozzle onto the sheet of receiving medium. The channel is then refilled by capillary action from the ink reservoir via the fluid supply manifold.

SUMMARY OF INVENTION

While ejecting fluid, fluid drawn from the fluid reservoir is directed through the passageways of the fluid supply manifold to each ejector channel. Contaminants, bubbles, debris, and/or residue located in the fluid reservoir can travel to the ejector channels. Filters within the fluid supply manifold and/or design techniques of the fluid supply manifold often trap the contaminants, bubbles, debris, and/or residue before they reach the fluid channels. However, some contaminants, bubbles, debris, and/or residue can reach the inlet of the ejector channels. Just as contaminants, bubbles, debris, residue, and/or deposits can accumulate on the face of the ejector head, thus clogging ejector nozzles and resulting in a deleterious effect on ejection quality, so too does the accumulation of contaminants, bubbles, debris, and/or residue at the inlet of the ejector channels negatively impact the ejection quality.

Removing solidified waste fluid and other contaminants, bubbles, debris, residue and/or deposits or the like from the face of the ejector head can be accomplished using any number of available methods, including, but not limited to, using a wiper blade, using a washing unit, and any combination of wiping and washing. While these have proven effective in removing solidified fluid or minute particles from the face of the ejector head, similar methods for clearing ejector channel inlets are not available. As a result, the ejection operation is diminished and slowed because several partial ejection swaths are required to cover the defects.

The inventor has determined that ejecting the fluid droplets, such as ink, from the ejector nozzle results in a back pressure within the ejector channel. This back force is directed out the channel inlet, often ejecting any residual fluid remaining in the channel back towards the fluid supply manifold.

This invention provides systems and methods for maintaining fluid ejection channels.

This invention separately provides systems and methods that remove at least some debris from a channel inlet.

This invention separately provides systems and methods for driving a fluid ejection system using a fluid ejection sequence.

This invention further provides systems and methods that move to a less harmful position at least some debris that interferes with proper fluid ejection from the ejector channels of the fluid ejection system using the fluid ejection sequence.

In various exemplary embodiments of the systems and methods according to this invention, at least some of a plurality of fluid ejectors are fired in a sequential pattern. In various exemplary embodiments, firing a fluid ejector results in a back pressure wave that moves debris, residue, contaminants, deposits or the like back out of the inlet of the fired fluid channel and/or any filter elements positioned on or near the inlet. In various exemplary embodiments, sequentially firing the fluid ejectors causes the back-ejected debris, residue, contaminants, deposits or the like within the fluid supply manifold to move along the direction of the firing sequence. In various exemplary embodiments of the systems and methods according to this invention, the moved contaminants, bubbles, debris, residue and/or deposits or the like can be deposited into locations within the fluid supply manifold that are not associated with operative fluid ejector channels.

In various exemplary embodiments of the systems and methods according to this invention, the fluid ejectors are fired in a sequential pattern within blocks of the fluid ejectors. For example, a fluid ejector head with, for example, 120 fluid ejectors can fire 1 out of every 20 fluid ejectors. Therefore, during a first period of the sequence, ejectors at positions 1, 21, 41, 61, 81 and 101 fire. Each fluid ejector is fired at least one time, and, in various exemplary embodiments, is fired multiple times, such as, for example, up to 100 times, before the next fluid ejector in the sequence is fired. Then, during a second period of the sequence, the fluid ejectors at positions 2, 22, 42, 62, 82, and 102 fire. Groups of fluid ejectors are fired in this manner until all 120 of the fluid ejectors have fired. This moves any debris, residue, contaminants, deposits or the like within the fluid supply manifold in the direction of firing, i.e., from position 20x+1 to position 20x+20.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Various exemplary embodiments of the systems and methods according to this invention allow fluid ejection systems to be maintained by using firing sequences of the fluid ejectors according to this invention. The mechanisms and techniques used for fluid ejection according to this invention allow moveable contaminants, bubbles, debris, residue and/or deposits or the like within a fluid supply manifold and/or inlet filters to be moved from ejector channel inlets using a back pressure wave resulting from firing of the fluid ejectors. In various exemplary embodiments, contaminants, bubbles, debris, residue and/or deposits or the like are moved within the fluid supply manifold in the direction of the firing sequence of the fluid ejectors.

In general, the contaminants, bubbles, debris, residue and/or deposits or the like dislodged by firing the fluid ejectors are moved into less-harmful positions within the fluid supply manifold. Such less harmful positions within the fluid supply manifold can include areas in which no fluid ejectors are connected, areas in which non-operative or dummy fluid ejector channels are connected, areas in which operative but de-selected fluid ejector channels are formed, or the like. It should be appreciated that, in various exemplary fluid ejection systems, fluid ejector channels can be de-selected for any of a variety of reasons. Such reasons include that a particular fluid ejector fails to properly operate, cannot be recovered from a particular failure mode, or the like. Fluid ejectors can also be de-selected based on a particular print algorithm used to select the operative fluid ejectors, such as during printing of partial and/or overlapping swaths. In various exemplary embodiments of the systems and methods of this invention, contaminants, bubbles, debris, residue and/or deposits or the like dislodged by firing the fluid ejectors can be moved or deposited into reservoirs, such as, for example, dummy and/or non-operative ejector channels or de-selected ejector channels that are next to the fluid ejectors or that are at an end of a row of fluid ejectors.

The following detailed description of various exemplary embodiments of the fluid ejection systems according to this invention may refer to one specific type of fluid ejection system, an ink jet printer, for the sake of clarity and familiarity. However, it should be appreciated that the principles of this invention, as outlined and/or discussed below, can be equally applied to any known or later-developed fluid ejection systems, beyond any ink jet printers specifically discussed herein.

Figure 1:
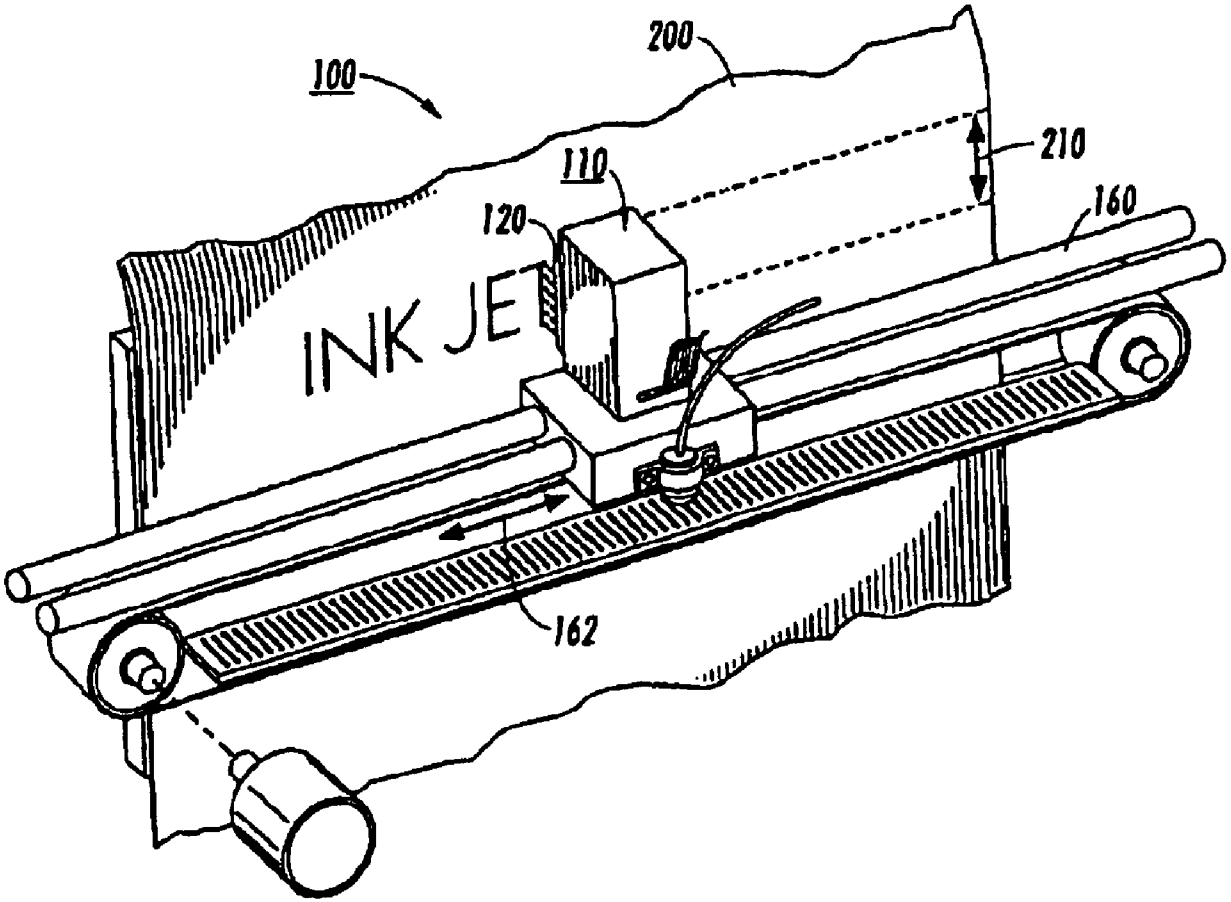
FIG. 1 is a partial perspective view of an exemplary fluid ejection system that includes a fluid ejector head with which the systems and methods of the invention are usable.

FIG. 1 is a partial perspective view of an exemplary embodiment ink jet system 100 that includes a fluid ejector head 110 that the systems and methods of the invention are usable with to reduce the effects of contaminants, bubbles, debris, residue and/or deposits or the like on the operation of fluid channels of the fluid ejector head 110.

As shown in FIG. 1, the fluid ejector head 110 is moveable along guide rails 160 in the directions indicated by the arrow 162. A receiving medium 200 is moveable in the directions indicated by the arrow 210, which is substantially perpendicular to the directions of movement of the fluid ejector head 110.

In operation, the fluid ejector head 110 is moved along a linear path. The length of the linear path is approximately defined by the sides of the receiving medium 200 so that the fluid ejector head 110 is capable of ejecting fluid along substantially the entire width of the receiving medium 200. When the fluid ejector head 110 reaches each side of the receiving medium 200, the receiving medium 200 is incrementally advanced in one of the directions of arrows 210 so that the fluid ejector head 110 is capable of ejecting fluid along substantially the entire length of the receiving medium 200.

The fluid ejector head 110 includes a channel body 130 and an aperture plate 120 at a side of the fluid ejector head 110 that is adjacent to the receiving medium 200. The aperture plate 120 and the channel body 130 can be disposed adjacent to or substantially adjacent to each other, with the aperture plate 120 being disposed facing the receiving medium 200. The aperture plate 20 and the channel body 130 can be integral and/or can be connected to each other by any suitable method or structure, such as, for example, by glue, epoxy, welding etc.

It should be appreciated, however, the aperture plate 120 and the channel body 130 do not have to be directly connect to each other. For example, other elements can be disposed between the aperture plate 120 and the channel body 130. Alternatively, the aperture plate 120 and the channel body 130 do not have to be separate elements.

Figure 2:
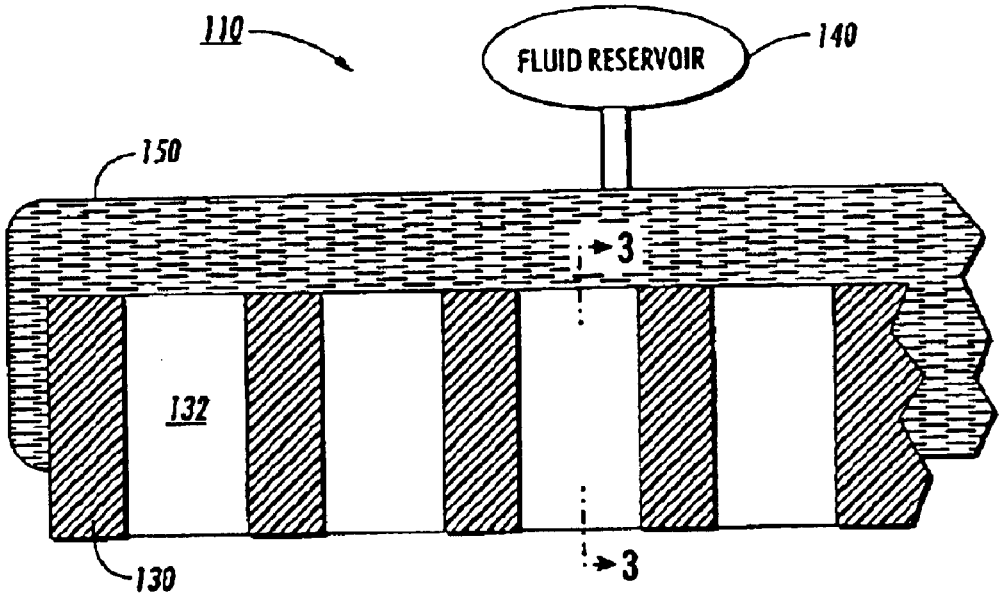
FIG. 2 illustrates one exemplary embodiment of a reservoir, a fluid supply manifold, and the channels of the fluid ejector head of FIG. 1.

FIG. 2 illustrates a top view of one exemplary embodiment of the components that comprise the fluid ejector head 110. As shown in FIG. 2, in this first exemplary embodiment, the channel body 130 contains a fluid reservoir 140, a fluid supply manifold 150, and a plurality of channels 132, which are substantially aligned with the ejector nozzles of the aperture plate 120 of the fluid ejector head 110. It should be appreciated that the fluid ejector head 110 may contain any number of channels 132.

The aperture plate 120 can be placed on or over the channel body 130. As fluid is ejected from the fluid ejectors channels 132 defined in the channel body 130, the fluid subsequently passes through the nozzles of the aperture plate 120 and onto the receiving medium 200.

It should be appreciated that the plurality of channels 132 of the fluid ejector head 110, as shown in FIG. 2, may be substantially aligned in the direction of the width of the aperture plate 120. The ejector channels 132 can be spaced at any desired distance, which may be determined based on a function of the fluid ejection system 100. Further, it should be appreciated that, as shown in FIG. 2, in various exemplary embodiments, the plurality of channels 132 are formed as a single row. However, in various other exemplary embodiments, two or more rows of the channels 132 may be used, as required, by the fluid ejection system 100.

The fluid reservoir 140 can be any device capable of holding fluid to be used in the fluid ejection system 100. The fluid supply manifold 150 can be any device capable of receiving fluid from the fluid reservoir 140 and distributing the fluid to the plurality of ejector channels 132. It should be appreciated that the fluid reservoir 140 and the fluid supply manifold 150, while depicted separately from each other and from the channel body 130, may not necessarily be separate and distinct components. Thus, the design, functions and/or operations of the fluid reservoir 140, the fluid supply manifold 150 and/or the channel body 130 may be carried out by any number of distinct components.

Figure 3:
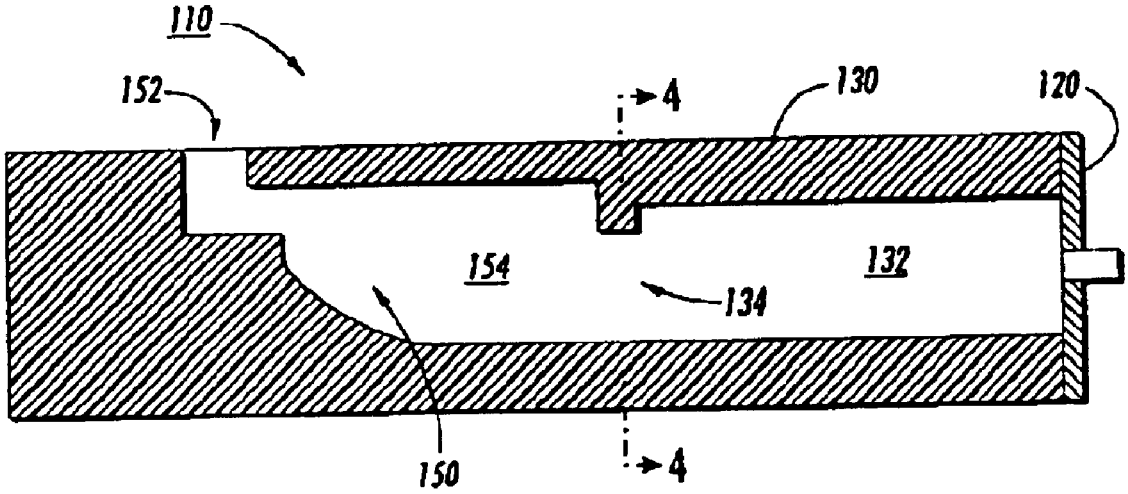
FIG. 3 is a side cross-sectional view of one exemplary embodiment of a fluid ejector head.

FIG. 3 is a side cross-sectional view of one exemplary embodiment of a fluid ejector head 110. As shown in FIG. 3, the fluid ejector head 110 includes the fluid supply manifold 150, the channel body 130, and the aperture plate 120. The fluid supply manifold 150, as shown in FIG. 3, includes a fluid inlet 152 and a fluid distribution passage 154. Fluid from the fluid reservoir 140 enters the fluid distribution passage 154 of the fluid supply manifold 150 via the fluid inlet 152. In operation, the fluid supply manifold 150 delivers the fluid to a plurality of the ejector channels 132. In various exemplary embodiments, the fluid ejector head 110 can contain a plurality of fluid supply manifolds 150 providing fluid to a plurality of distinct sets of the ejector channels 132.

Alternatively, the fluid ejector head 110 can include a fluid supply manifold 150 in which the fluid distribution passage is divided into distinct portions that are not necessarily in fluid communication with each other. In this case, each such distinct portion may have its own fluid inlet 152. Each distinct portion of the fluid distribution passage 154 supplies fluid primarily to the associated set of the plurality of ejector channels 132. It should be appreciated that the design of the fluid ejector head 110, including the fluid supply manifold 150, ejector channels 132, and aperture plate 120 will be obvious and predictable to those skilled in the art.

Figure 4:
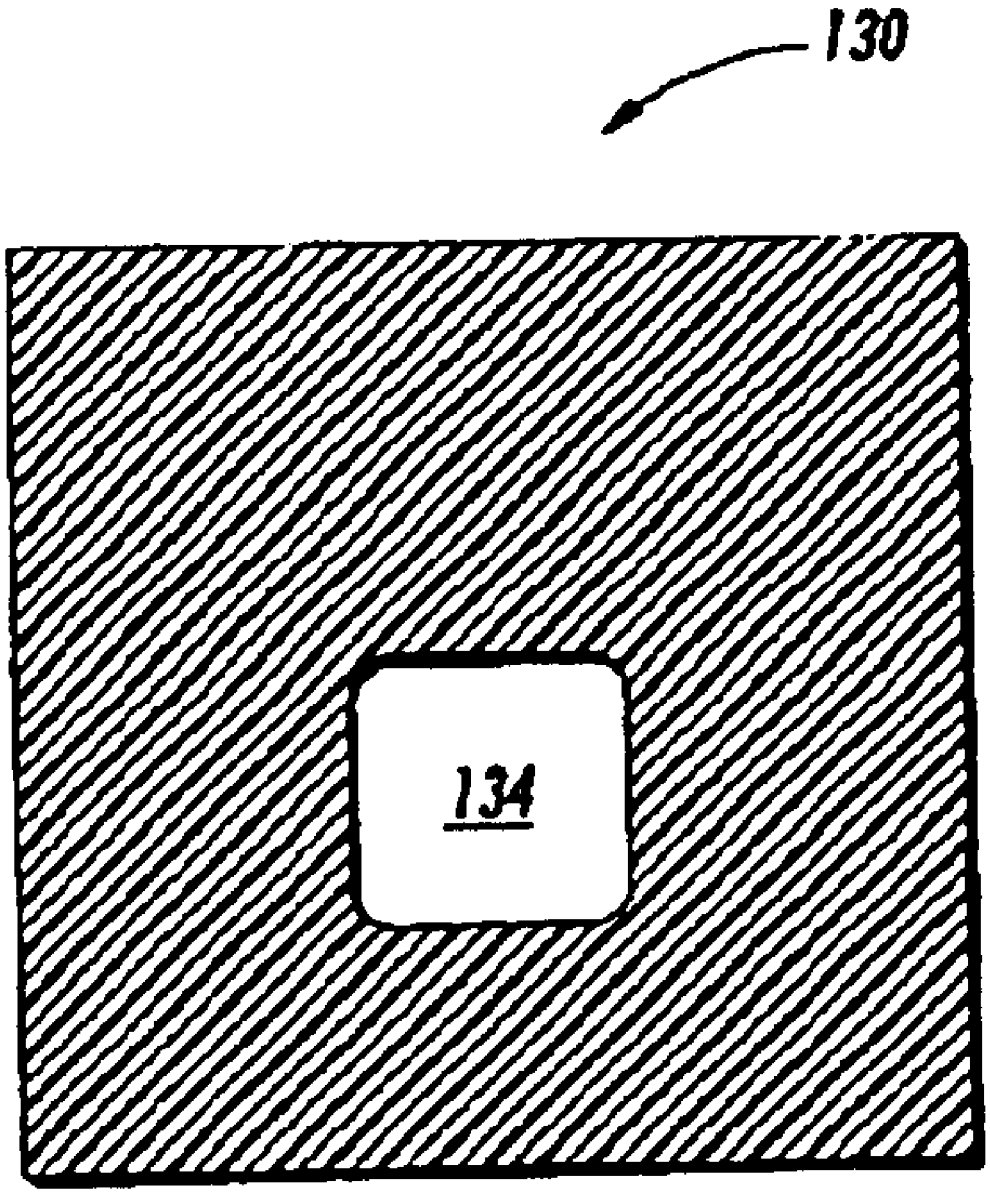
FIG. 4 is a rear view of one exemplary embodiment of an ejector channel.

FIG. 4 is a cross-sectional view taken along the line 4—4 of FIG. 3. FIG. 3 depicts the channel inlet 134 from the fluid distribution passage 154 to the ejector channel 132. The channel inlet 134 allows fluid from the fluid supply manifold 150 to enter into the ejector channel 132. In various exemplary embodiments, the channel inlet 134 is smaller than the cross-sectional flow area of the ejector channel 132. It should be appreciated that the particular size and shape of the channel inlet 134 will be obvious and predictable to those skilled in the art.

Although not depicted, it should be further appreciated that the fluid supply manifold 150 can employ various filtering techniques, including, but not limited to, filters and unique fluid supply manifold passageway designs to contain and/or trap contaminants, bubbles, debris, and/or residue within the fluid supply manifold 150. Such contaminants, bubbles, debris, and/or residue not trapped and/or contained within the fluid supply manifold 150 can accumulate at the channel inlet 134 and/or enter into the channel 132. When the debris, residue, contaminants, deposits or the like collect at or within the channel inlet 134, the cross-sectional flow area of the channel inlet 134 can become significantly reduced. This reduces the amount of fluid that can flow into the fluid channel 132 between a last firing and a next firing of that channel 132. A partially-filled fluid channel 132 will generally not eject a drop of fluid correctly. Additionally, as the fluid acts to cool the resistive heater of a thermal fluid ejector, the resistive heater can overheat and fail due to such improper filling.

If the debris, residue, contaminants, deposits or the like collect in the fluid channel 132 itself, these same problems can occur. Additionally the debris, residue, contaminants, deposits or the like in the ejector channel 132 can become lodged in the nozzle or can decompose, coat the resistive heater of a thermal system or otherwise detrimentally affect the fluid channel 132 and/or the nozzle.

Figure 5:
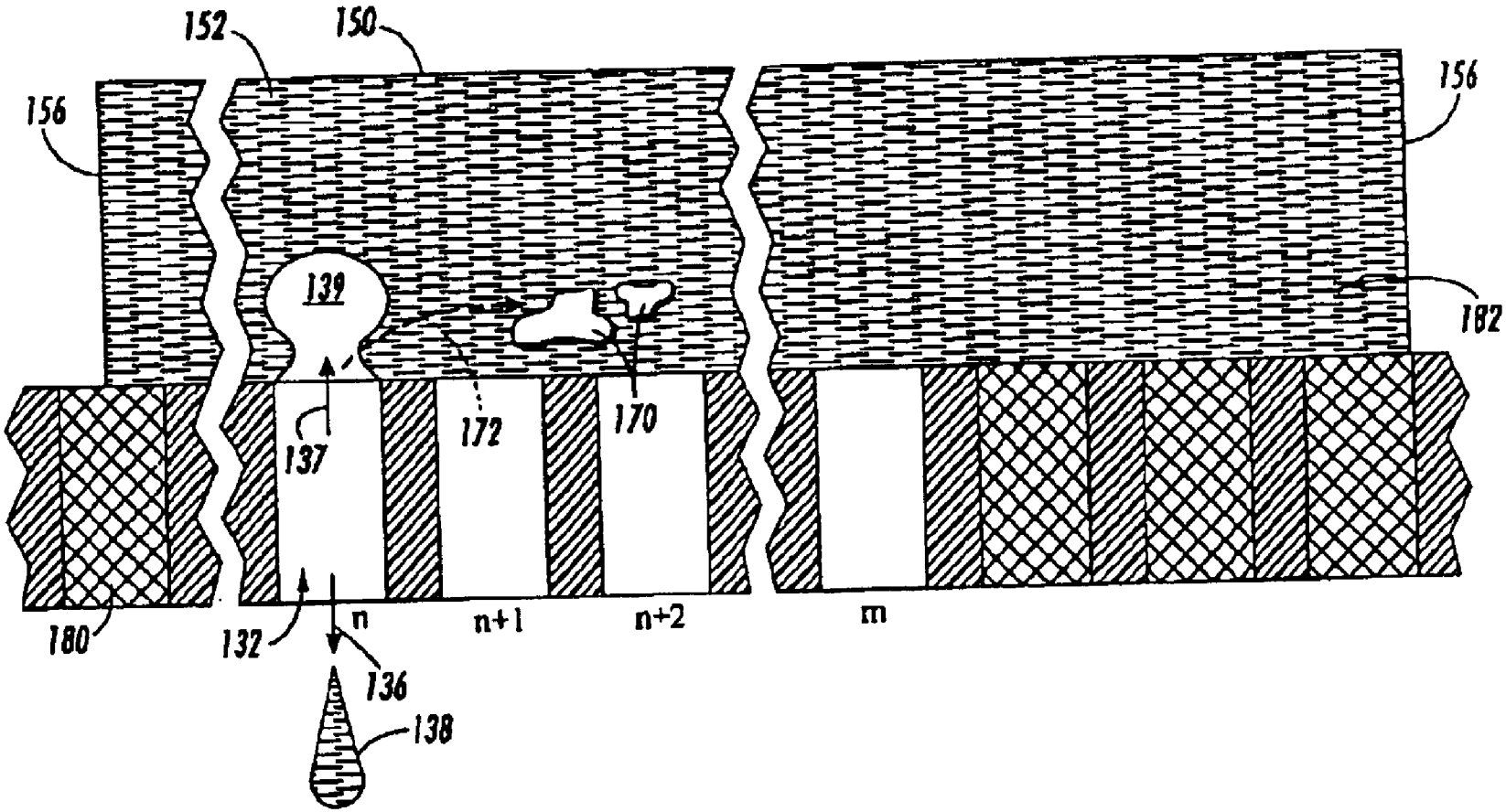
FIG. 5 illustrates one exemplary embodiment of an n period of the first exemplary embodiments of the fluid drop ejection sequence according to this invention.

FIGS. 5–8 illustrate a number of periods of a first exemplary embodiment of the ejector firing sequence according to this invention. As shown in FIGS. 5–8, the fluid supply manifold 150, having a number of end walls 156, provides the fluid to the plurality of ejector channels 132. In FIGS. 5–8, fluid flows in direction 136 through a plurality of nozzles. As shown in FIG. 5, during an $n^{th}$ period of the fluid drop ejection sequence, a fluid drop 138 is ejected from the $n^{th}$ channel 132. It should be appreciated that, in this first exemplary embodiment, and as well as any other exemplary embodiment according to this invention, each period can include one or more firings of the current ejector channel 132. Thus, in various exemplary embodiments, a large number of firings, such as 100 firings, of each ejector channel 132 can occur during each period.

During operation, particles 170 can collect and/or form on, in and/or near the channel inlet 134 and can adversely affect the fluid drop 138 exiting the ejector channel 132. These adverse effects include, but are not limited to, restricting and/or blocking the channel inlets 134. The particles 170 can be any substance that is capable of obstructing the channel inlet 134, including solidified fluid, dust, and the like. The particles 170 can also be bubbles of air or the like that are present in the fluid. In general, the particles 170 are anything other than fluid that can freely flow through the channel inlet 134.

When fluid ejects from the ejector channels 132, a back pressure pulse 139 is directed backwards from the channel inlet 134 into the fluid supply manifold 150, often ejecting any residual fluid remaining in the ejector channel 132 back towards the fluid supply manifold 150. The resulting back pressure pulses 139 tend to dislodge the particles 170 in a direction 172 towards and possible pass the adjacent $(n+1)^{th}$ ejector channel 132. In various exemplary embodiments, the force of the back pressure pulses 139 dislodges the particles 170. However, it should be appreciated that some other physical process that occurs in response to the back pressure pulses 139 being directed back into the fluid supply manifold 150 may be responsible for dislodging the particles. 170.

Although the particles 170 are depicted as dislodging in the direction 172, it should be appreciated that the direction that any given particle 170 moves is predicated on its position on and/or around the $n^{th}$ channel inlet 134 and/or the force and/or angle with which any given back pressure pulse 139 impacts that particular particle 170. Subsequently, a dislodged particle 170 can land on part or portion of other channel inlets 134, including, but not limited to that space between the ejector channels 132. For example, in FIG. 5, the particles 170 can be dislodged in the direction 172 towards the $n+1^{th}$ ejector channel 132 but could land between the $n^{th}$ ejector channel 132 and the $n+1^{th}$ ejector channel 132.

Accordingly, in various exemplary embodiments of the firing sequence according to this invention, each ejector channel 132 is fired a plurality of times, such as, for example, 100 times. In various exemplary embodiments, it is believed that, each time a given ejector channel 132 is fired, the resulting back pressure pulse 139 further dislodges additional particles 170 and/or further moves of the particles 170 away from that ejector channel 132. In various exemplary embodiments, the size of the back pressure pulse 139 and the number of times each ejector channel 132 is fired combines move the particles 170 from around the $n^{th}$ ejector channel 132 to at least more than halfway past the next $n+1^{th}$ ejector channel 132.

This will tend to place those particles in a position such that, during the $(n+1)^{th}$ period, when that next $n+1^{th}$ ejector channel 132 is fired, those particles 170 will tend to move towards the next $n+2^{th}$ ejector channel 132 and not back toward the $n^{th}$ ejector channel 132. This will also tend, during the $n^{th}$ period, to move any particles 170 near the channel inlet 134 of the $n+1^{th}$ ejector channel 132 that are relatively closer to the $n^{th}$ ejector channel 132 than to the $n+2^{th}$ ejector channel 132 toward the $n+2^{th}$ ejector channel 132. Thus, those particles 170 will also tend to be placed on a position such that, when the $n+1^{th}$ ejector channel 132 is fired during those $(n+1)^{th}$ period, those particles 170 will also tend to move towards the $n+2^{th}$ ejector channel 132 instead of back towards the $n^{th}$ ejector channel 132.

It should be appreciated that the number of pulses to be fired during each period can be predetermined, could have been empirically determined during design, development and/or manufacturing of the fluid ejector head as that number that is sufficient to adequately move the particles 170, or could be dynamically determined during operation based on the degree of adverse printing effects or the like. This dynamic determination can be performed by the user or by a controller (not shown).

Figure 6:
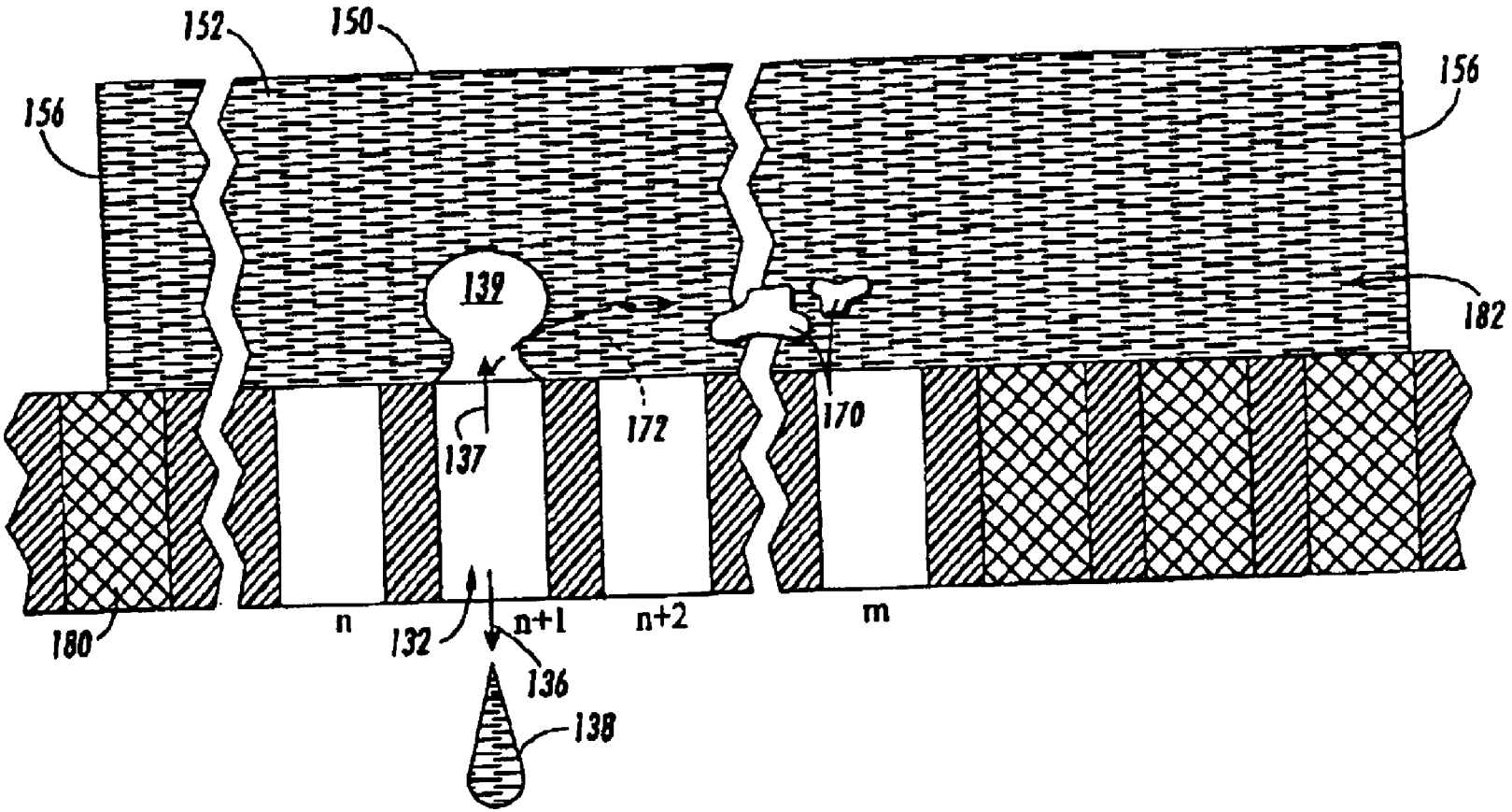
FIG. 6 illustrates one exemplary embodiment of an (n+1) $^{th}$ period of the first exemplary embodiment of the fluid drop ejection sequence according to this invention.

FIG. 6 illustrates an exemplary embodiment of the $(n+1)^{th}$ period of the first exemplary embodiment of the fluid ejection sequence. After the $n^{th}$ ejector channel 132 depicted in FIG. 5 has been fired the one or more times, the particles 170 have moved from the positions shown in FIG. 5 towards the positions shown in FIG. 6. FIG. 6 shows the $(n+1)^{th}$ ejector channel 132 ejecting a drop 138. The resulting back pressure pulse 139 dislodges or further moves the particles 170 in the direction 172. The particles 170 will generally tend to include not only those particles dislodged from previous ejector channels 132, but also additional particles 170 dislodged from the $n+1^{th}$ channel 132.

Also as discussed above, the direction that the particles 170 moves in FIG. 6 is predicated on its position on, in and/or around the channel inlet 134 and/or the force and/or angle with which the back pressure pulse 139 impacts the particles 170. Subsequently, the particles 170 can land on part or portion of other channel inlets 134, including, but not limited to that space between the ejector channel 132.

Figure 7:
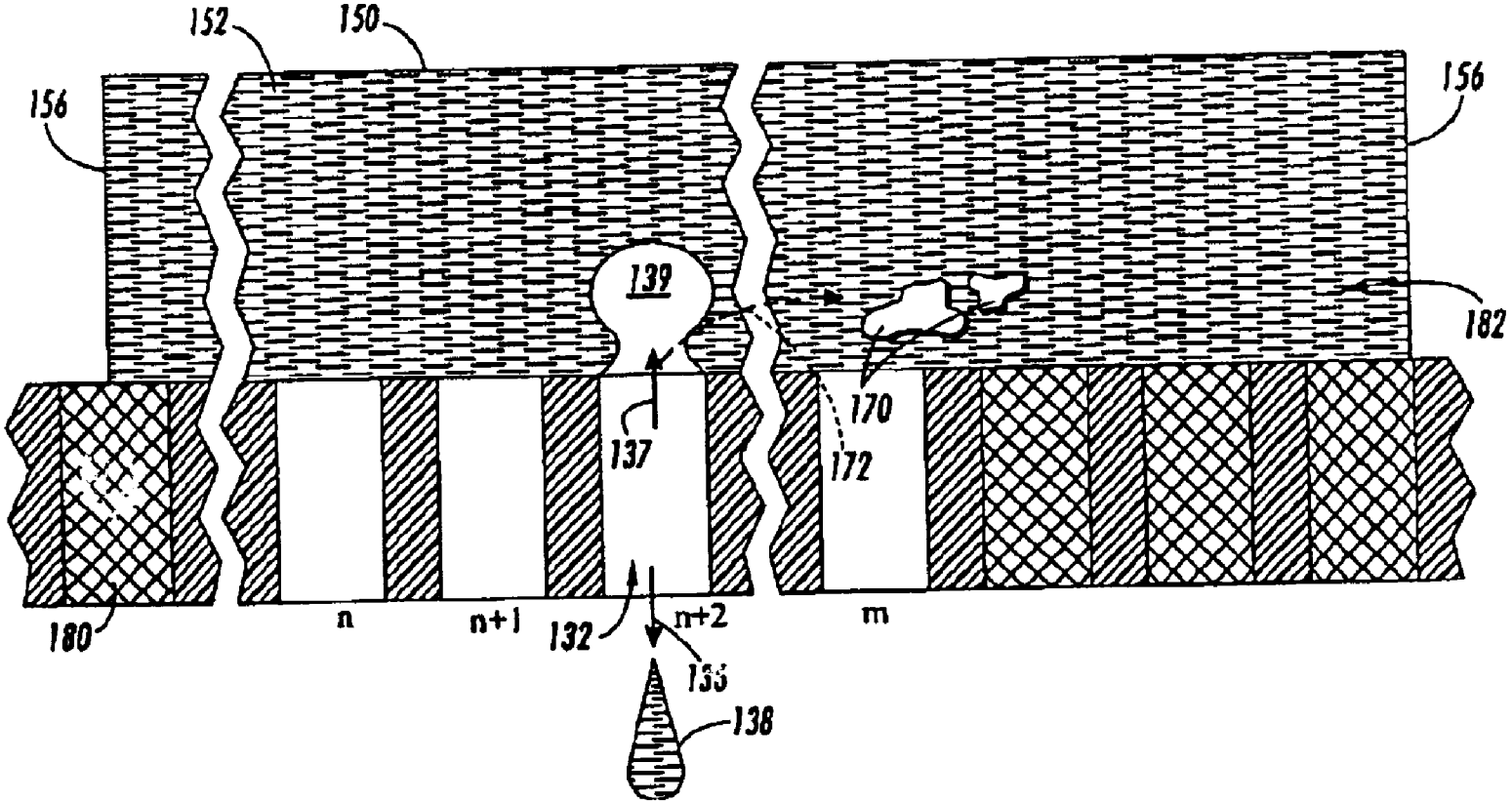
FIG. 7 illustrates one exemplary embodiment of an (n+2) $^{th}$ period of th e first exemplary embodiment of the fluid drop ejection sequence according to this invention.

FIG. 7 illustrates an exemplary embodiment of the $(n+2)^{th}$ period of the first exemplary embodiment of the fluid ejection sequence. After the $(n+1)^{th}$ ejector channel 132 depicted in FIG. 6 has been fired the one or times, the particles 170 have moved from the positions shown in FIG. 6 towards the positions shown in FIG. 7. FIG. 7 shows the $(n+2)^{th}$ ejector channel 132 ejecting a drop 138. The resulting back pressure pulse 139 dislodges or further moves the particles 170 in the direction 172. The particles 170 will generally tend to include not only those particles dislodged from the previous ejector channels 132, but also additional particles 170 dislodged from $(n+2)^{th}$ ejector channel 132.

Also as discussed above, the direction that the particles 170 moves in FIG. 7 is predicated on its position on, in, and/or around the channel inlet 134 and/or the force and/or angle with which the back pressure pulse 139 impacts the particles 170. Subsequently, the particles 170 can land on part or portion of other channel inlets 134, including, but not limited to that space between the ejector channels 132.

Figure 8:
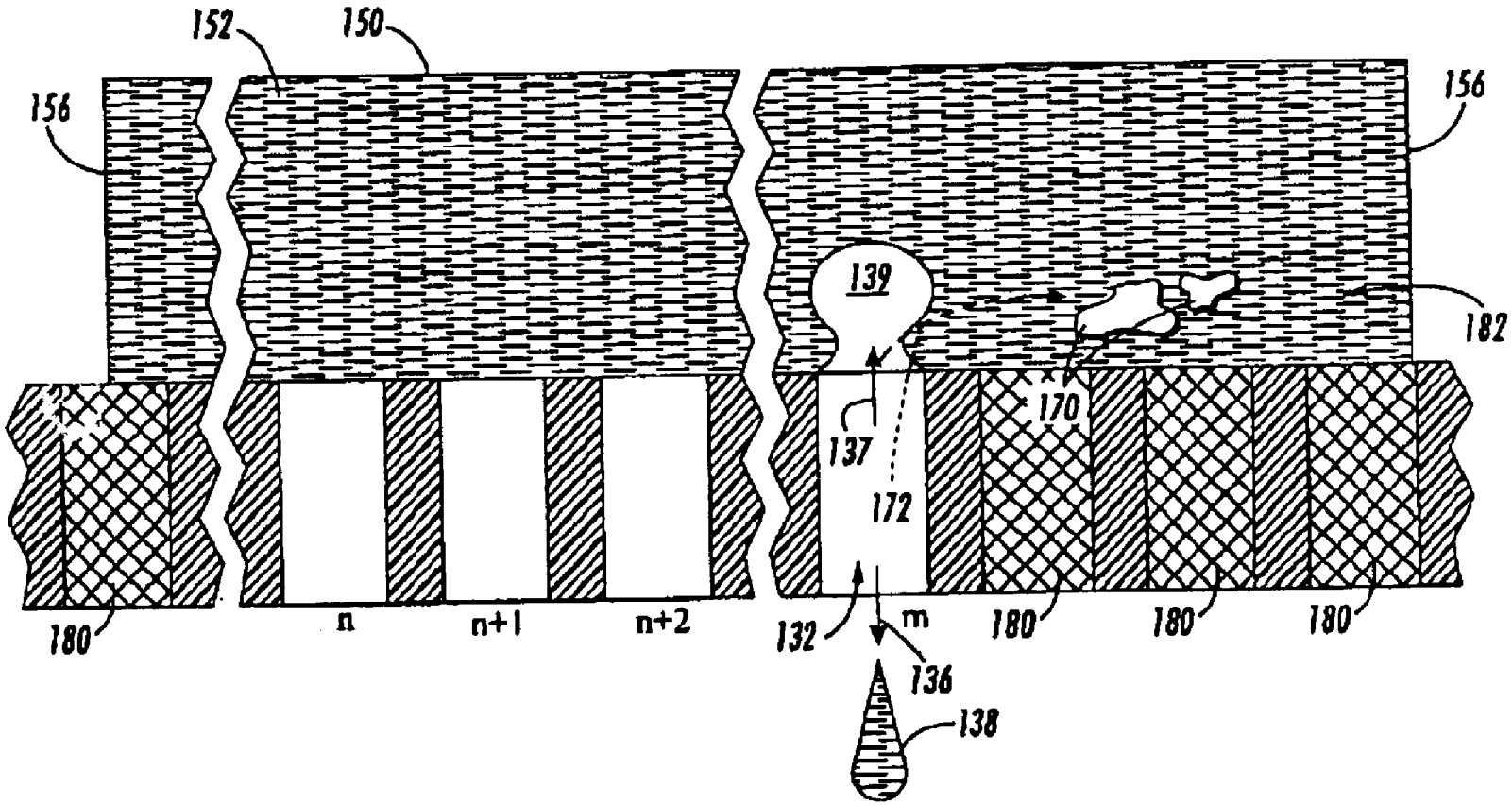
FIG. 8 illustrates one exemplary embodiment of a last period of the first exemplary embodiment of the fluid drop ejection sequence according to this invention.

FIG. 8 illustrates an exemplary embodiment of the $m^{th}$ or last period of the first exemplary embodiment of the fluid ejection sequence. After the $(n+2)^{th}$ ejector channel 132 depicted in FIG. 7, and any intervening ejection channel(s) have been fired the one or more times, the particles 170 have moved from the positions shown in FIG. 7 towards the positions shown in FIG. 8. FIG. 8 shows the $m^{th}$ ejector channel 132 ejecting a drop 138. The resulting back pressure pulse 139 dislodges or further moves the particles 170 in the direction 172. The particles 170 will generally tend to include not only those particles dislodged from all of the previous ejector channels 132, but also additional particles 170 dislodged from $m^{th}$ ejector channel 132.

Also as discussed above, the direction that the particles 170 moves in FIG. 8 is predicated on its position on, in, and/or around the channel inlet 134 and/or the force and/or angle with which the back pressure pulse 139 impacts the particles 170. Subsequently, the particles 170 can land on part or portion of other channel inlets 134, including, but not limited to that space between the ejector channels 132.

As shown in FIG. 8, non-operative ejector channels 180, or a space where an ejector channel 132 could have been formed but has not been, are situated after the $m^{th}$ or last ejector channel 132. Although three non-operative ejector channels 180 are shown, it should be appreciated that any number of non-operative ejector channels 180, such as, for example, dummy ejector channels, failed ejector channels and/or de-selected ejector channels or size of the space can be used. As shown in FIG. 8, the dislodged particles 170 accumulate in and/or around the non-operative ejector channels 180.

It should be appreciated that the ejector channels 132 shown in FIGS. 5–8 represent any segment of an array of the fluid ejector channels 132. For example, the ejector channels 132 in FIGS. 5–8 can be at the beginning, the middle, or end of an array of ejector channels 132.

It should be further appreciated that, though it is not depicted, the sequential fluid ejection illustrated in FIGS. 5–7 with respect to the $n^{th}$, $(n+1)^{th}$, and $(n+2)^{th}$ ejector channels 132, respectively, continues with the sequential firing of the remaining ejector channels 132 until all the ejector channels 132 in a given array have fired. Any dislodged particles 170 that move along the array of ejector channels 132 as a result of the back pressure pulse 139 generated by the sequential firing can be dislodged and/or moved by the $m^{th}$ or last ejector channel 132 that fires into an area 182 that collects such moveable contaminants. Any particle 170 dislodged or removed from the channel inlets 134 during the sequential firing process and deposited onto the area 182 away from the operative ejector channels 132, such as, for example, a non-operative channel 180.

Figure 9:
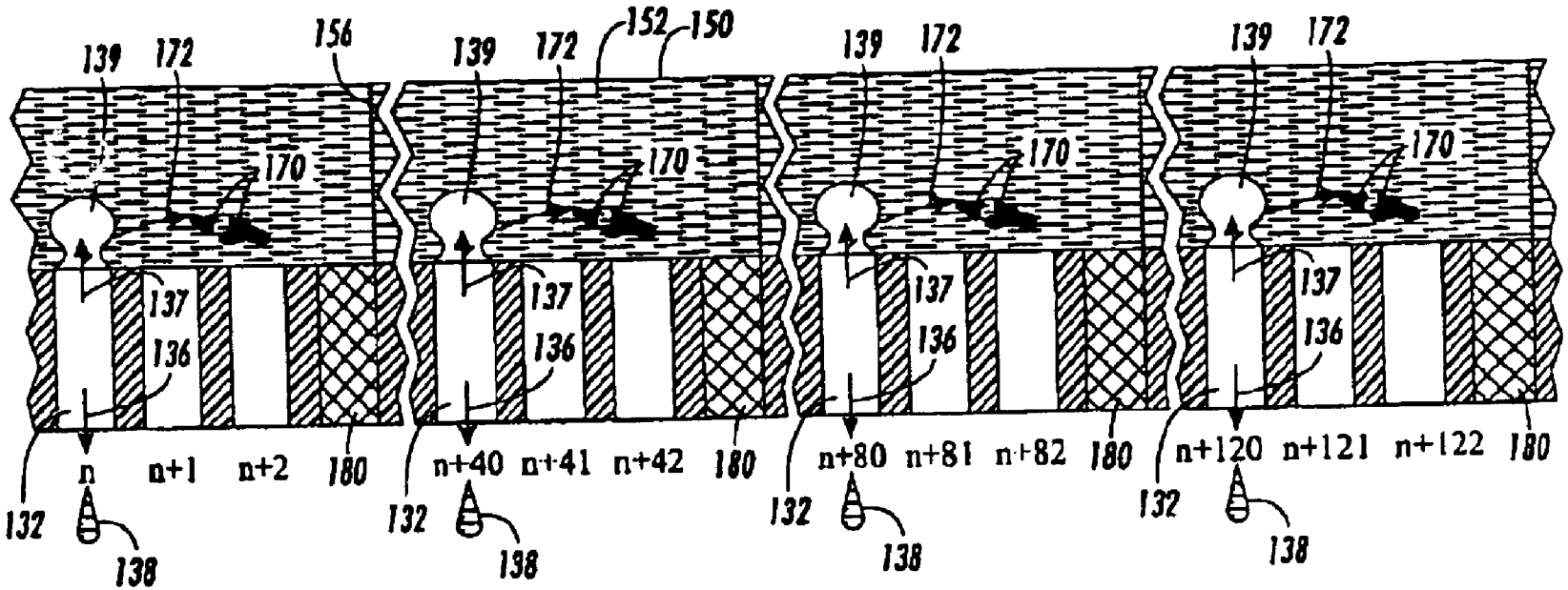
FIG. 9 illustrates one exemplary embodiment of discrete segments of second-to-last periods of a second exemplary embodiment of the fluid drop ejection sequence according to this invention.
Figure 10:
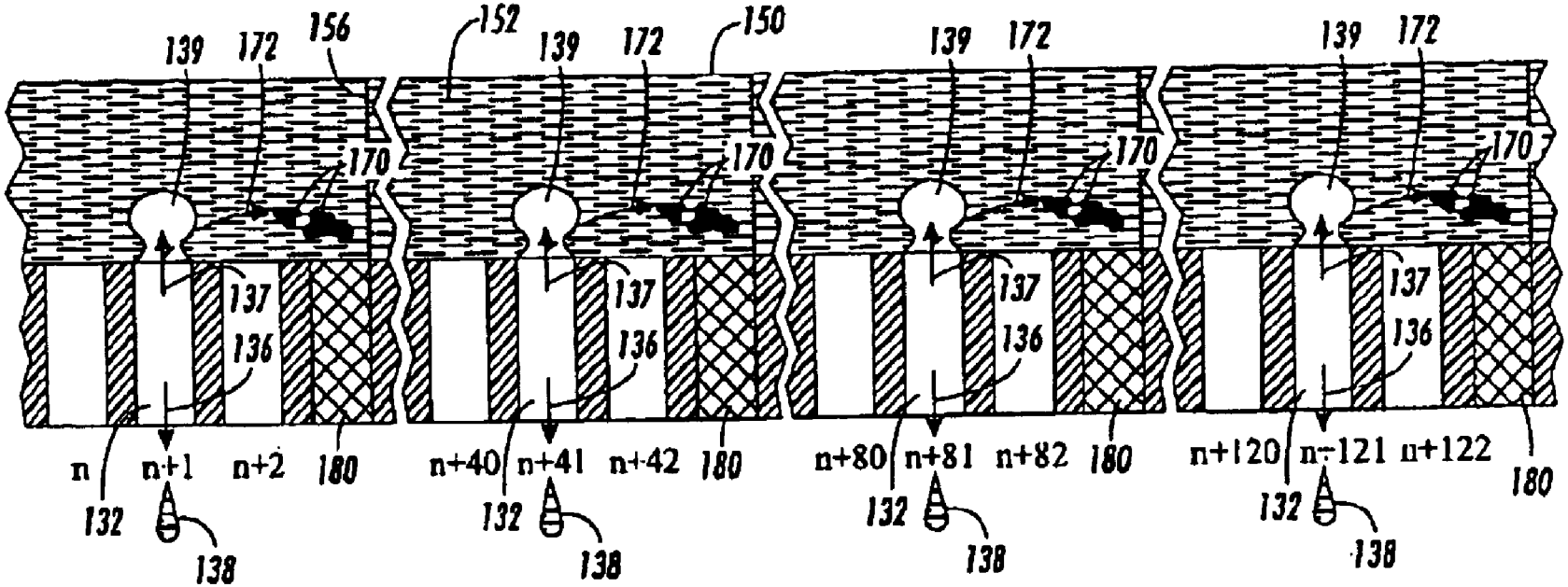
FIG. 10 illustrates one exemplary embodiment of discrete segments of next-to-last periods of the second exemplary embodiment of the fluid drop ejection sequence according to this invention.
Figure 11:
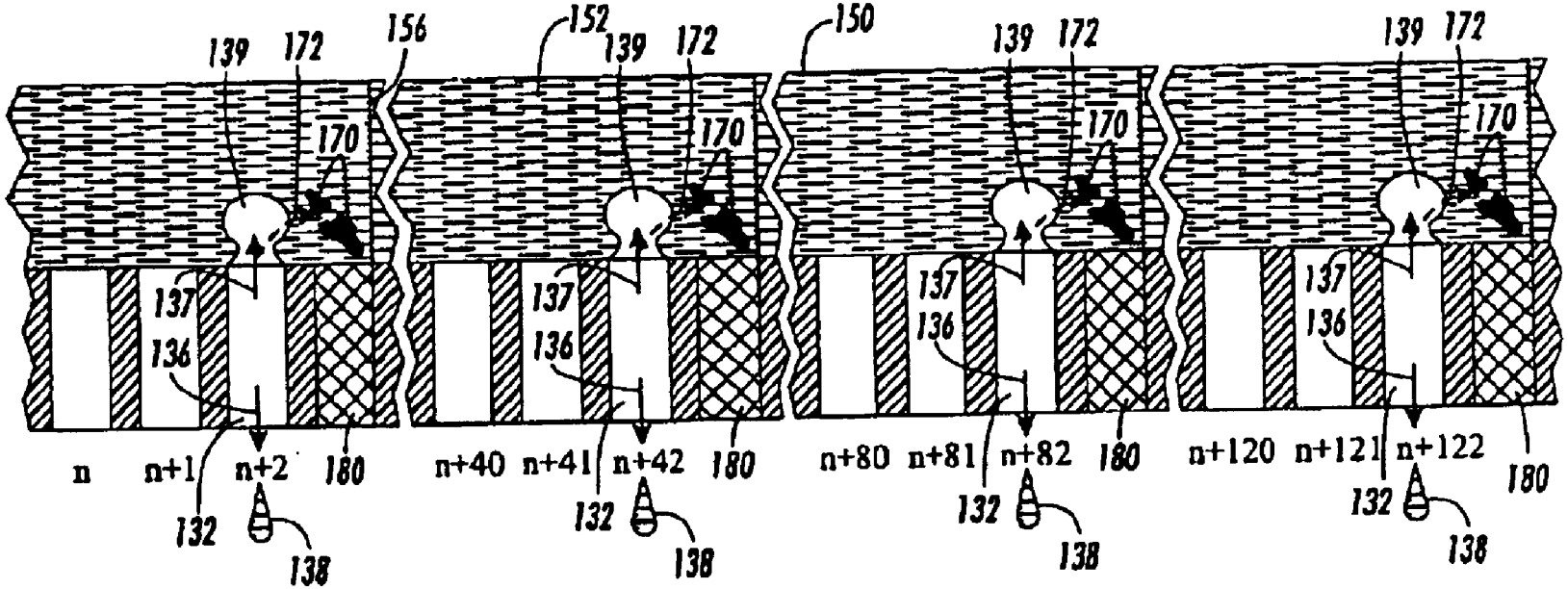
FIG. 11 illustrates one exemplary embodiment of discrete segments of last periods of the second exemplary embodiment of the fluid drop ejection sequence according to this invention.

FIGS. 9–11 show a number of consecutive periods of a second exemplary embodiment of the ejector firing sequence and a second exemplary embodiment of the ejector body 130 and the fluid supply manifold 150 according to this invention. In FIGS. 9–11, in this second exemplary embodiment of the firing sequence, the ejector channels 132 within the fluid ejector body 130 are, at least operationally, divided into discrete sections separate from the others by various ones of the end, or partition, walls 156. In the specific embodiment shown in FIGS. 9–11, the ejector channels 132 are divided, at least operationally, into sections of 40 ejector channels 132. Although the ejector channels 132 in FIGS. 9–11 are divided at least operationally into sections of 40 ejector channels 132, it should be appreciated that the array of ejector channels 132 can be divided into at least operational sections of any desired number, for example, sections of 10 channels, 20 channels, or 30 channels. It should be further appreciated that the ejector channels 132 shown in FIGS. 9–10 could be depicting the beginning, middle, or end sections of a row of channels.

In FIGS. 9–11, fluid flows in the direction 136 through the plurality of ejector channels 132, ejecting drops 138 from the ejector channels 132. As shown in FIGS. 9–11, zero, one or more non-operative channels 180 of the area 182 are associated with each at least operationally-associated set of 40 operative ejector channels 132. Although only one non-operative channel 180 is shown associated with each at least operationally-associated set of 40 operative ejector channels 132, it should be appreciated that any number of non-operative channels 180, or a space of any appropriate size, can be associated with each at least operationally-associated set of operative ejector channels 132 in the area 182.

In various exemplary embodiments, sequentially firing the fluid drops 138 through the ejector channels 132 can be enhanced by using a regular firing pattern. For example, by firing drops simultaneously through certain ones of the ejector channels 132 using a pattern, such as a pattern where one out of every 40 ejector channels 132 is fired, the resulting back pressure pulse 139 can move the contaminants, bubbles, debris, residue and/or deposits 170 or the like that has collected in and/or around the channel inlet 134 in the direction of the firing sequence for more than a single ejector channel at a time.

As shown in FIG. 9, fluid is ejected at the same time out of the ejector channels 132 at positions n, n+40, n+80, n+120 and for a given number of drops. Any contaminants, bubbles, debris, residue and/or deposits 170 or the like are moved from the channel inlet 134 of the n+40x channels 132 in the direction 172. In the next period of the firing sequence, as depicted in FIG. 10, fluid is ejected at the same time from the next set of the ejector channels 132 at the positions n+1, n+41, n+81, and n+121, etc. and for a given number of drops. The sequential firing sequence continues as depicted in FIG. 11 with drops 138 being ejected through the next set of the ejector channels 132 at the positions n+2, n+42, n+82, and n+122. Eventually, as a result of the back pressure pulses 139 generated by sequentially firing the drops of fluid through the ejector channels 132, any contaminants, bubbles, debris, residue and/or deposits 170 or the like end up in the area 182.

It should be appreciated that any number of drops 138 can be ejected by each of the ejector channels 132. Thus, for example, in various exemplary embodiments, each ejector channel 132 ejects the same number of drops 138. In contrast, in various other exemplary embodiments, each ejector channel 132 ejects a particular number of drops 138, which, in general, will be different from at least one other one of the ejector channels 132.

It should also be appreciated that the fired ejector channels 132, although shown immediately adjacent to each other in FIGS. 1–11, could be spaced from each other by one or more intervening operative or non-operative ejector channels 132. Thus, if the particles 170 dislodged by the back pressure pulses 139 are displaced by two or more channel separations, it may be advantageous to skip one or more channels between a pair of driven ejector channels 132.

Figure 12:
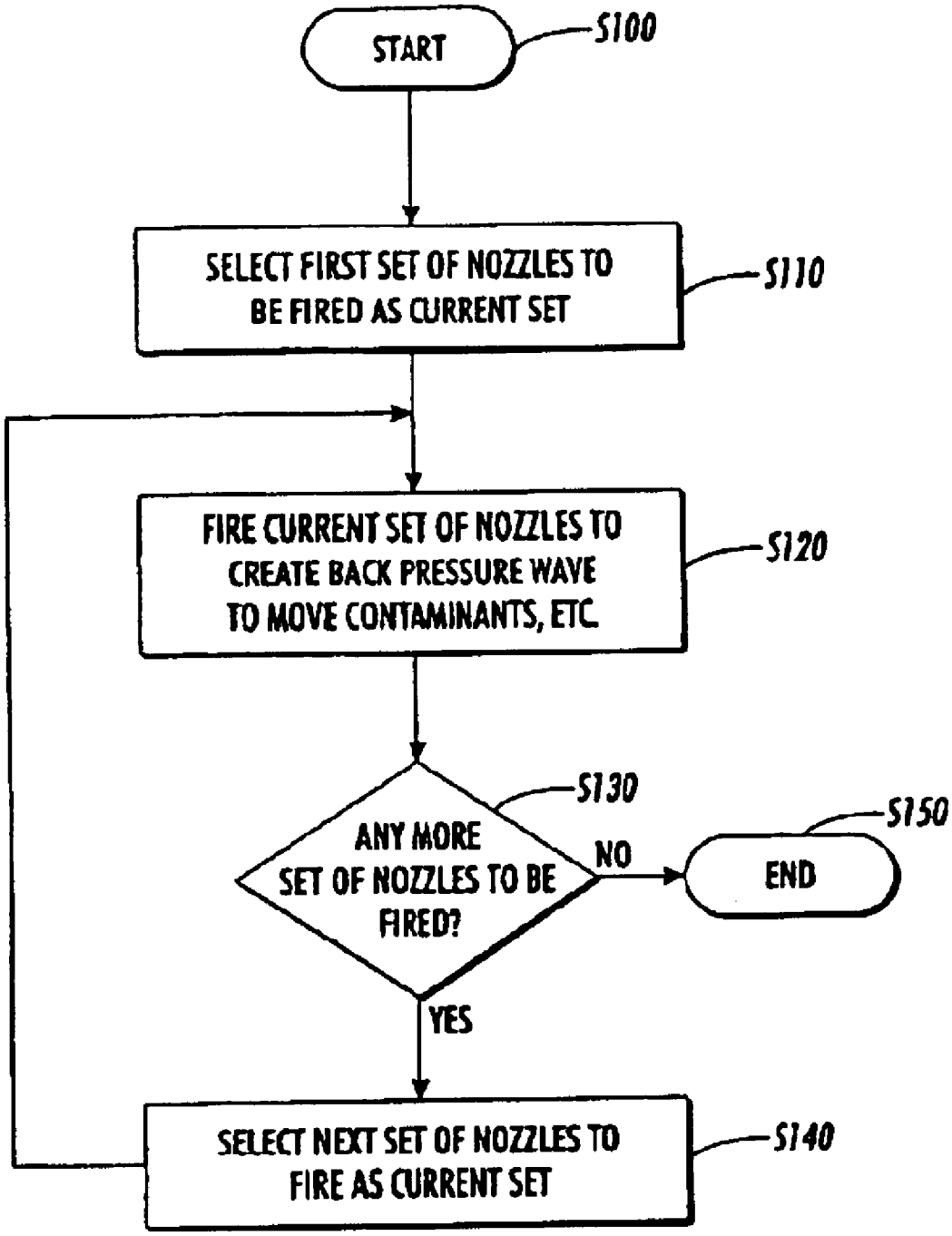
FIG. 12 is a flow chart outlining an exemplary embodiment of a method for fluid ejection sequencing.

FIG. 12 is a flowchart outlining one exemplary embodiment of a method for ejecting fluid in a sequence according to this invention. As shown in FIG. 12, operation of the method begins in step S100 and continues to step S110, where the first set of channels to be fired is selected. Then, in step S120, the current set of channels is fired a given number of times to move any contaminants, bubbles, debris, residue and/or deposits back from the channel inlet into the fluid supply fluid supply manifold toward at least a next channel. Next, in step S130, a determination is made whether there is an additional set of channels that need to be fired. If no additional set of channels needs to be fired, operation continues to step S140. Otherwise, operation jumps to step S150.

In step S140, the next set of nozzles are selected as the current set to be fired. Operation then jumps back to step S120. In contrast, in step S150, operation of the method ends.

It should be appreciated that, in various exemplary embodiments, the method outlined above is performed during a maintenance operation to move any of the contaminants, bubbles, debris, residue, and/or deposits that may have collected in and/or around the channel inlet 134 to less-harmful positions. Such a maintenance operation can be performed as part of a regular overall maintenance operation or can be performed when desired by the operator. It should further be appreciated that the method outlined above could be performed during normal printing operations. In particular, the method outlined above could be performed when an analysis of the print data indicates that the desired sequence of firing the fluid ejectors at least the desired number of times can be performed at the same time that the fluid is ejected to form the desired pattern of ejected fluid on the receiving medium.

While this invention has been described in conjunction with the exemplary embodiments outlined above, it is evident that many alternatives, modifications and variations will be apparent to those skilled in the art. Accordingly, the exemplary embodiments of the invention as set forth above, are intended to be illustrative, not limiting. Various changes may be made without departing from the spirit and scope of the invention.

What is claimed is:

1. A method for moving movable particles within a fluid supply manifold of a fluid ejector head that includes a plurality of fluid ejectors, comprising:

driving a first one of the plurality of fluid ejectors at least a desired number of times to displace at least some of the movable particles in a desired direction within the fluid supply manifold;

driving a second one of the plurality of fluid ejectors at least the desired number of times, the second one of the plurality of fluid ejectors spaced from the first one of the plurality of fluid ejectors in the desired direction, to displace at least some of the movable particles in the desired direction within the fluid supply manifold, the at least some of the movable particles including at least some of the movable particles moved by driving the first one of the plurality of fluid ejectors.

2. The method of claim 1, further comprising repeating the second driving step for each of at least one additional one of the plurality of fluid ejectors, wherein each additional one of the plurality of fluid ejectors is spaced from a preceding one of the plurality of fluid ejectors in the desired direction.

3. The method of claim 2, wherein a last one of the at least one additional one of the plurality of fluid ejectors displaces at least some of the movable particles into at least one of a non-operative area within the fluid supply manifold and at least one non-operative fluid ejector region of the fluid ejector head.

4. The method of claim 3, wherein, once the at least some of the movable particles are displaced into the non-operative area, such movable particles no longer adversely affect fluid drops ejected from the plurality of fluid ejectors.

5. The method of claim 3, wherein the at least one of a non-operative area includes at least one of areas associated with at least one of no fluid ejectors, at least one dummy fluid ejector channel, at least one failed fluid ejector channel, at least one de-selected fluid ejector channel and at least one area that includes fluid ejectors that are only used during a maintenance operation of the fluid ejector head.

6. The method of claim 2, wherein driving each additional one of the plurality of fluid ejectors that is spaced from a preceding one of the plurality of fluid ejectors in the desired direction comprises driving each additional one of the plurality of fluid ejectors that is adjacent to the preceding one of the plurality of fluid ejectors along the desired direction.

7. The method of claim 2, wherein a number of drops ejected by each additional one of the plurality of fluid ejectors is the same as the number of drops ejected by the second one of the plurality of fluid ejectors.

8. The method of claim 2, wherein a number of drops ejected by each additional one of the plurality of fluid ejectors is the different from the number of drops ejected by at least some of other ones of the plurality of fluid ejectors.

9. The method of claim 1, wherein driving the second one of the plurality of fluid ejectors that is spaced from the first one of the plurality of ejectors in the desired direction comprises one of the plurality of fluid ejectors that is adjacent to the first one of the plurality of fluid ejectors along the desired direction.

10. The method of claim 1, wherein a number of drops ejected by the first one of the plurality of fluid ejectors is the same as the number of drops ejected by the second one of the plurality of fluid ejectors.

11. The method of claim 1, wherein a number of drops ejected by the second one of the plurality of fluid ejectors is the different from the number of drops ejected by the first one of the plurality of fluid ejectors.

12. A method for moving movable particles within a supply manifold of a fluid ejector head that includes a plurality of fluid ejectors that are organized into a number of sets of fluid ejectors, comprising:

driving a first fluid ejector of each of the sets of fluid ejectors at least a desired number of times to displace at least some of the movable particles in a desired direction within the fluid supply manifold;

driving a second fluid ejector of each of the sets of fluid ejectors at least a desired number of times, the second fluid ejectors of the sets of fluid ejectors spaced from the first fluid ejectors of the sets of fluid ejectors in the desired direction, to displace at least some of the movable particles in the desired direction, the at least some of the movable particles including at least some of the movable particles moved by driving the first fluid ejectors of the sets of fluid ejectors.

13. The method of claim 12, further comprising repeating the second driving step for each of at least one additional fluid ejector of each of the sets of fluid ejectors, wherein, for each set, each additional fluid ejector of that set of fluid ejectors is spaced from a preceding fluid ejector of that set of fluid ejectors in the desired direction.

14. The method of claim 13, wherein, for each set, a last fluid ejector of the at least one additional one fluid ejector of that set of fluid ejectors displaces at least some of the movable particles into at least one of: at least one non-operative area of the fluid supply manifold and at least one non-operative fluid ejector region of the fluid ejector head.

15. The method of claim 14, wherein, once the at least some of the movable particles are displaced into at least one of: at least one non-operative area and at least one non-operative fluid ejector region, such movable particles no longer adversely affect fluid drops ejected from the plurality of fluid ejectors.

16. The method of claim 14, wherein the at least one non-operative area includes at least one of areas associated with at least one of no fluid ejectors, at least one dummy fluid ejector channel, at least one failed fluid ejector channel, at least one de-selected fluid ejector channel and at least one area that includes fluid ejectors that are only used during a maintenance operation of the fluid ejector head.

17. The method of claim 14, wherein the at least one non-operative area comprises at least one dead area associated with each one of the number of sets of fluid ejectors.

18. The method of claim 13, wherein driving each additional fluid ejector of that set of fluid ejectors that is spaced from a preceding fluid ejector of that set of fluid ejectors in the desired direction comprises driving each additional fluid ejector of that set of fluid ejectors that is adjacent to the preceding fluid ejector of that set of fluid ejectors along the desired direction.

19. The method of claim 13, wherein, for at least one set, a number of drops ejected by each additional fluid ejector of that set of fluid ejectors is the same as the number of drops ejected by the second fluid ejector of that set of fluid ejectors.

20. The method of claim 13, wherein, for at least one set, a number of drops ejected by each additional fluid ejector of that set of fluid ejectors is different from the number of drops ejected by at least some of other fluid ejectors of that set of fluid ejectors.

21. The method of claim 12, where, for at least one set, the second fluid ejector of that set of fluid ejectors is adjacent to the first fluid ejector of that set of fluid ejectors along the desired direction.

22. The method of claim 12, wherein driving the second fluid ejector of that set of fluid ejectors that is spaced from the first fluid ejector of that set of fluid ejectors in the desired direction comprises driving the second fluid ejector of that set of fluid ejectors that is adjacent to the preceding fluid ejector of that set of fluid ejectors along the desired direction.

23. The method of claim 12, wherein, for at least one set, a number of drops ejected by the first fluid ejector of that set of fluid ejectors is the same as the number of drops ejected by the second fluid ejector of that set of fluid ejectors.

24. The method of claim 12, wherein, for at least one set, a number of drops ejected by the second fluid ejector of that set of fluid ejectors is the different from the number of drops ejected by the first fluid ejector of that set of fluid ejectors.

* * * * *